US005229759A

United States Patent [19]

Wong

[11] Patent Number: 5,229,759

[45] Date of Patent: Jul. 20, 1993

[54] AUTO-OFFSET LCD VERTICAL SCROLL MECHANISM

[75] Inventor: Harvey Wong, Kowloon, Hong Kong

[73] Assignee: Motorola Inc., Schaumburg, Ill.

[21] Appl. No.: 749,073

[22] Filed: Aug. 23, 1991

[51] Int. Cl.[5] ..... G09G 1/16

[52] U.S. Cl. ..... 340/726; 340/784

[58] Field of Search ..... 340/747, 784, 792, 724–727; 358/241, 236

[56] References Cited

U.S. PATENT DOCUMENTS

| | | | |
|---|---|---|---|
| 4,442,495 | 4/1984 | Sukonick | 340/726 |
| 4,491,834 | 1/1985 | Oguchi | 340/726 |
| 4,633,415 | 12/1986 | Vink et al. | 340/726 |
| 4,940,970 | 7/1990 | Fujisaku | 340/726 |
| 5,091,723 | 2/1992 | Kanno et al. | 340/784 |

*Primary Examiner*—Ulysses Weldon
*Assistant Examiner*—Gin Goon
*Attorney, Agent, or Firm*—Bradley J. Botsch, Sr.

[57] ABSTRACT

A LCD vertical scrolling mechanism automatically tracks addresses of information scrolled on a LCD. A counter is initialized to a value latched in a vector register when a frame signal is received. Subsequent BPCLK signals step the adder through a series of values. These values are relayed through two bus selectors to segment drivers for the LCD. One of the bus selectors is coupled to the counter in parallel with a subtracter. When a value from the counter exceeds a predetermined value equal to the MUX of the LCD, the subtracter takes the difference between the predetermined MUX value and the value received from the counter and directs the parallel bus selector to relay the difference to the RAM of a segment driver. An adder is coupled to the other bus selector and to the vector register. When the MCU needs to fetch information from the segment drivers, the MCU relays a LCD address where the information is displayed, to the adder. The adder adds the address (a value) to the value latched in the vector register. The MCU directs the second bus selector to select the value determined in the adder and relay this address to the segment driver.

5 Claims, 1 Drawing Sheet

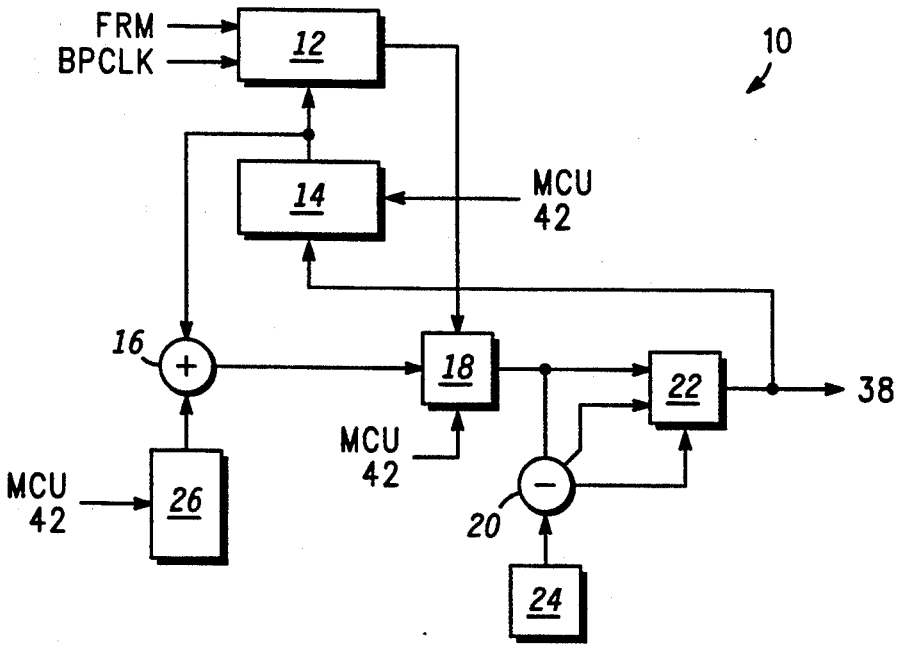
FIG. 1
FIG. 2
-PRIOR ART-
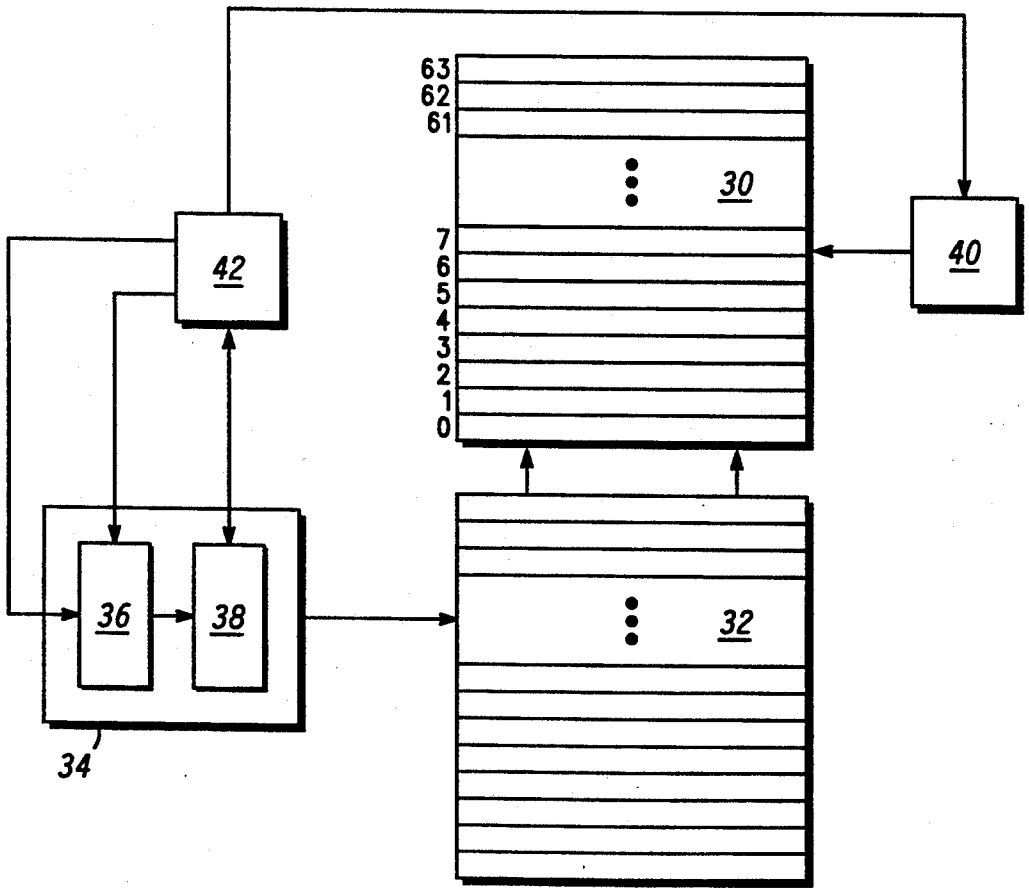

AUTO-OFFSET LCD VERTICAL SCROLL MECHANISM

BACKGROUND OF THE INVENTION

This invention relates, in general, to Liquid Crystal Display (LCD) drivers, and more specifically, to LCD scrolling mechanisms.

LCDs are controlled by a number of LCD drivers. These drivers include the backplane driver(s) which activates, with a high voltage signal, a row(s) on the LCD which is to be displayed, and further includes generally two or more segment drivers. The segment drivers control what information is to be displayed in the rows of the LCD. Therefore, when a row of information is to be displayed on the LCD, it is stored/organized in the segment driver by commands from a micro-control unit (MCU) and displayed in the appropriate LCD row via the operation of the backplane driver.

Often while operating a LCD, information must be scrolled up or down on the screen any given number of rows. Almost all segment drivers having built in RAM (random access memory) can perform this scrolling function in a very simple manner.

Generally, each LCD system with built-in RAM segment drivers receives a frame signal (FRM) and a backplane clock signal (BPCLK). The FRM signal operates to set a counter within the segment driver to an initial value. Each BPCLK signal or pulse operates to advance the counter by one up to a predetermined value, whereupon another FRM signal is received.

In operation, if the FRM signal sets the counter to zero, row zero of the RAM is fetched into display. At the first BPCLK signal row one of the RAM is fetched into display and so on until the next FRM signal is received. If, however, the counter initially loads a one as the initial number rather than a zero, row one will be displayed rather than row zero. Row two will be displayed upon the first BPCLK pulse rather than row one, and so on until row zero of the RAM is shown followed by the next FRM. In this manner the image is effectively scrolled by one dot line (row).

Although the scrolling by prior art scrolling mechanisms is effective, such scrolling is not user friendly. Physically on the LCD screen row zero of the RAM is in the top row of the LCD screen. The MCU is required to keep track of the location of each row of data in relation to each scrolled row on the screen. As a result, the MCU must continually track the vertical scrolling and carefully update the segment driver counters. Additionally, if the RAM is oriented into byte-row form instead of bit-row form, smooth vertical scrolling becomes even more tedious.

SUMMARY OF THE INVENTION

A LCD vertical scrolling mechanism automatically tracks addresses of information scrolled on a LCD. A counter is initialized to a value latched in a vector register when a frame signal is received. Subsequent BPCLK signals step the adder through a series of values. These values are relayed through two bus selectors to segment drivers for the LCD. One of the bus selectors is coupled to the counter in parallel with a subtracter. When a value from the counter exceeds a predetermined value equal to the MUX of the LCD, the subtracter takes the difference between the predetermined MUX value and the value received from the counter and directs the parallel bus selector to relay the difference to the RAM of a segment driver. An adder is coupled to the other bus selector and to the vector register. When the MCU needs to fetch information from the segment drivers, the MCU relays a LCD address where the information is displayed, to the adder. The adder adds the address (a value) to the value latched in the vector register. The MCU directs the second bus selector to select the value determined in the adder and relay this address to the segment driver.

The above and other objects, features, and advantages of the present invention will be better understood from the following detailed description taken in conjunction with the accompanying drawings.

BRIEF DESCRIPTION OF THE DRAWING

FIG. 1 is a schematic of a auto-offset LCD vertical scroll mechanism according to the present invention.

FIG. 2 is a simple schematic of a prior art LCD vertical scrolling mechanism.

DETAILED DESCRIPTION OF THE INVENTION

U.S. application Ser. No. 07/749,071 entitled LCD DRIVER AND CONTROL UNIT filed Aug. 23, 1991, having the same inventors and assigned to the same assignee is hereby incorporated by reference. This application describes the operation of the LCD drivers in conjunction with the LCD and the MCU.

An auto-offset mechanism 10 for vertical scrolling of information in LCD screens is shown in the schematic of FIG. 1. Auto-offset mechanism 10 comprises counter 12, vector register 14, adder 16, bus selector 18, subtracter 20, bus selector 22, wrap around register 24, and data buffer 26. Auto-offset mechanism 10 is coupled to a MCU 42 and to a RAM 32 of a segment driver.

Counter 12 is coupled to vector register 14 and to bus selector 18. Vector register 14 is further coupled to MCU 42 and adder 16. Bus selector 18 is further coupled to adder 16, to MCU 42, subtracter 20, and to bus selector 22. Adder 16 is further coupled to data buffer 26, and data buffer 26 is coupled to MCU 42. Subtracter 20 receives inputs from wrap around register 24, and generates two outputs (discussed subsequently), both of which are relayed to bus selector 22. Bus selector 22 is coupled to RAM 32 through output 38.

The advantages of auto-offset mechanism 10 are better understood by a discussion of a conventional counter, shown in FIG. 2. In FIG. 2, a LCD 30 is coupled to a RAM 32 of a segment driver 34. Segment driver 34 comprises a counter/vector register 36, and other elements of segment driver 34, such as data interfacing and control devices, all of which are represented by block 38. A backplane driver 40 is coupled to LCD 30, and coupled to MCU 42. MCU 42 supplies FRM and BPCLK signals to counter/vector register 36. Block 38 is coupled to MCU 42, and the connection may be one-way or two-way depending upon the control device in block 38 which is interfacing with MCU 42. It should be noted that the transfer of information between MCU 42 and block 38 is not shown nor described completely since the emphasis is on explaining the scrolling of information and its relation with counter 36. Other operations of LCD drivers are discussed in U.S. application Ser. No. 749,071 incorporated by reference above.

A scroll-down operation is described hereafter due to the configuration of LCD 30. If the configuration were reversed, the following discussion would relate to a scroll-up. A scroll-up using the configuration of FIG. 2 will be described subsequently in conjunction with the present invention.

The FRM signal received from MCU 42 initializes counter 36. Before scrolling, counter/vector register 36 is generally set at an initial value of zero. Although counter/vector register 36 is described for ease of explanation as a simple unit, counter/vector register 36 actually comprises a separate counter and vector register. The vector register stores the initial value which is received from MCU 42, and this value is retrieved by the counter with each FRM signal. The FRM signal to counter/vector register 36 causes information in row zero of RAM 32 to be displayed in row zero of LCD 30 assuming the vector register has a content of zero.

At the first BPCLK signal, row one of RAM 32 is displayed in row one of LCD 30. The second BPCLK signal causes the information in row two of RAM 32 to be displayed in row two and so on until all 64 rows of LCD 30 are displayed. Another FRM signal is then received and re-initializes counter 36, beginning the process over again.

When scrolling down by one row, counter/vector register 36 is initialized to one rather than zero. Therefore, the FRM signal will cause information in row one of RAM 32 to be displayed in row zero of LCD 30. Information in row zero of RAM 32 is subsequently displayed in row 63 of LCD 30 as result of the correction operation of subtracter 20 and bus selector 22 of FIG. 1.

The information displayed on LCD 30 can be scrolled any number of rows by storing the appropriate value in the vector register. For instance, if the screen is to be scrolled up another row, the value of the vector register is two and counter 36 is initialized to two. Therefore, information in row two of RAM 32 is displayed in row zero of LCD 30, and so on.

As mentioned previously, MCU 42 is required to keep track of the scrolled information between LCD 30 and RAM 32 using the prior art method.

According to the present invention, auto-offset mechanism 10 independently tracks the scrolled information thus freeing MCU 42 for other purposes.

The operation of auto-offset mechanism 10 can be explained by referencing FIG. 1. Auto-offset mechanism 10 is shown connected to elements of segment driver 38, and thus to RAM 32 and LCD 30, all of which were referenced in FIG. 2.

Prior to scrolling, vector register 14 is set to zero. Therefore, when a FRM signal is received, counter 12 is initialized to zero. The signal from counter 12 indicating address zero is received by bus selector 18, and is relayed on to segment driver 38 through bus selector 22. At the same time, the address signal output from bus selector 22 is stored in vector register 14.

Similar to the system described in FIG. 2, information from RAM 32 will be displayed in corresponding rows of LCD 30 (row zero of RAM 32 displayed in row zero of LCD 30) prior to scrolling assuming the value of vector register 14 is initially set at zero.

When information in RAM 32 is to be scrolled down in LCD 30 by, for example, one row, a signal from MCU 12 is received by vector register 14 which sets vector register 14 to one. When FRM is received, counter 12 will check vector register 14 for any preset value. With vector register 14 set to one, counter 12 will initialize to one.

With counter 12 initialized at one, bus selector 18 receives a one as the address of data in RAM 32 to be displayed in row zero of LCD 30. The first signal from BPCLK increases the address signal from counter 12 by one to ensure that data in row two of RAM 32 is displayed in row one of LCD 30, and so on.

The value in wrap around register 24 will equate to the number of rows of LCD 30 and RAM 32. For instance, for a 64 MUX LCD, the value in wrap around register 24 will be 64.

Assuming a 64 MUX LCD 30, the signal from counter 12 will eventually reach 64 before BPCLK stops. BPCLK may surpass 64 as explained below. Since RAM 32 is also only 64 MUX, the signal must wrap-around to bring the information in row zero of RAM 32 into row 63 of LCD 30. Subtracter 20 continuously monitors the output of bus selector 18. When the output of bus selector 18 equals or exceeds the value stored in wrap around register 24 (which value corresponds to the MUX of RAM 32 and LCD 30), subtracter 20 subtracts the value stored in wrap around register 24 from the value retrieved from the output of bus selector 18. Subtracter 20 then sends a signal to bus selector 22 directing bus selector 22 to select the value from subtracter 20 rather than the value from bus selector 18. This new value is then selected by bus selector 22 and relayed to segment driver elements 38. This value is the address in RAM 32 of the information to be displayed in the next row of LCD 30. In this case, the address is row zero of RAM 32 to be displayed on row 63 of LCD 30.

When a row of information is to be fetched from RAM 32, an address signal from MCU 42 is sent to data buffer 26 indicating the row of LCD 30 where the information is displayed. Adder 16 retrieves the address in data buffer 26 and adds the address value to the value received from vector register 14. The subsequent address in adder 16 is the row in RAM 32 where the information is stored. A signal from MCU 42 to bus selector 18 directs bus selector 18 to retrieve the address from adder 16. The address is then sent through bus selector 22 to segment driver elements 38.

Auto-offset mechanism 10 is used for scrolling up in addition to scrolling down. The same procedure is followed for scrolling up as for scrolling down using inputs to data buffer 26 to determine the location of the address.

Auto-offset mechanism 10 allows a user to treat the first row of the LCD as row zero at all times without knowing the actual physical address of the data or information in the RAM. Furthermore, the MCU is not required to track the physical location of the information with relation to the LCD.

Thus there has been provided, in accordance with the present invention, a LCD vertical scroll mechanism that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A liquid crystal display (LCD) scrolling mechanism coupled to a segment driver(s) for a LCD, wherein information manipulated by the segment driver(s) and displayed in the LCD is controlled by a micro-control unit (MCU), the LCD scrolling mechanism comprising:

counter means coupled to the MCU, the MCU supplying frame (FRM) signals and backplane clock (BPCLK) signals to said counter means;

the MCU also supplying an initializing value to said counter means;

said FRM signal initializing said counter means to said initializing value;

said counter means for counting through a series of values when a series of said BPCLK signals are received;

address selector means coupled to said counter means for determining an address in the segment driver for each of said series of values generated by said counter means and for relaying said address to the segment drivers and to said counter means, said address selector means including:

wrap-around register;

subtracter coupled to said counter means;

first bus selector coupled to said counter means and to said subtracter;

said first bus selector further coupled to the segment driver(s);

said first bus selector and said subtracter receiving said series of values from said counter means;

said wrap-around register relaying to said subtracter a predetermined value equal to a number of rows of the LCD;

said subtracter subtracting each of said series of values from said predetermined value and relaying a select signal to said first bus selector each time one of said each of said series of values is equal to or greater than said predetermined value;

said subtracter relaying a difference between said each of said series of values and said predetermined value to said first bus selector each time one of said each of said series of values is equal to or greater than said predetermined value; and said first bus selector relaying said address to the segment driver(s), said address being substantially equal to each of said series of values when each of said series of values is less than said predetermined value, said address being substantially equal to said difference between said each of said series of values and said predetermined value each time one of said each of said series of values is equal to or greater than said predetermined value.

2. A LCD scrolling mechanism according to claim 1 wherein said counter means comprises:

counter coupled to the MCU, said counter receiving said FRM signals and said BPCLK signals;

vector register coupled to said counter and to the MCU, said vector register receiving said initializing value from the MCU and storing said initializing value;

said counter retrieving said initializing value from said vector register when said FRM signal is received;

said counter generating said series of values from said BPCLK signals; and said counter coupled to said first bus selector and to said subtracter for relaying said series of values to said first bus selector and to said subtracter.

3. A LCD scrolling mechanism according to claim 1 wherein the scrolling mechanism further comprises:

adder coupled to said vector register to receive either said initializing value or said address;

data register coupled to the MCU and to said adder;

said adder further coupled to said first bus selector;

the MCU relaying a LCD address to said data register when information in said LCD address is to be retrieved by the MCU;

said adder retrieving said LCD address from said data register and adding said LCD address to said initializing value to obtain a scrolled address;

second bus selector coupled between said counter means and said first bus selector;

said second bus selector further coupled to the MCU and receiving a select signal from said MCU;

said second bus selector selecting said series of values from said counter means until said select signal is received from the MCU, whereupon said second bus selector selects said scrolled address from said adder; and said second bus selector relaying either said series of values or said scrolled address to said first bus selector and said subtracter.

4. A liquid crystal display (LCD) scrolling mechanism coupled to a segment driver(s) for a LCD, information manipulated by the segment drivers and displayed in the LCD is controlled by a micro-control unit (MCU), the LCD scrolling mechanism comprising:

counter coupled to the MCU, the MCU supplying frame (FRM) signals and backplane clock (BPCLK) signals to said counter;

vector register coupled to said counter and to the MCU;

the MCU supplying an initializing value to said vector register;

said counter retrieving said initializing value from said vector register when said FRM signal is received;

said counter generating a series of values in response to said BPCLK signals;

wrap-around register;

subtracter coupled to said counter;

first bus selector coupled to said counter and to said subtracter;

said first bus selector further coupled to the segment driver(s);

said first bus selector and said subtracter receiving said series of values from said counter;

said wrap-around register relaying to said subtracter a predetermined value equal to a number of rows of the LCD;

said subtracter subtracting each of said series of values from said predetermined value and relaying a select signal to said first bus selector each time one of said each of said series of values is equal to or greater than said predetermined value;

said subtracter relaying a difference between said each of said series of values and said predetermined value to said first bus selector each time one of said each of said series of values is equal to or greater than said predetermined value;

said first bus selector relaying to the segment driver(s) each of said series of values when each of said series of values is less than said predetermined value; and said first bus selector relaying to the segment driver(s) and to said vector register said difference between said each of said series of values and said predetermined value each time one of said each of said series of values is equal to or greater than said predetermined value.

5. A LCD scrolling mechanism according to claim 4 wherein the scrolling mechanism further comprises:

adder coupled to said vector register to receive either said initializing value or said difference between said each of said series of values and said predetermined value;

data register coupled to the MCU and to said adder;

the MCU relaying a LCD address to said data register when information in said LCD address is to be retrieved by the MCU;

said adder retrieving said LCD address from said data register and adding said LCD address to said initializing value, or to said difference between said each of said series of values and said predetermined value to obtain a scrolled address;

second bus selector coupled to said counter, to said subtracter, and to said first bus selector;

said second bus selector further coupled to the MCU and receiving a select signal from said MCU;

said second bus selector selecting said series of values from said counter until said select signal is received from the MCU, whereupon said second bus selector selects said scrolled address from said adder; and said second bus selector relaying either said series of values or said scrolled address to said first bus selector.

* * * * *